United States Patent [19]

Bettoni et al.

[11] 4,397,065

[45] Aug. 9, 1983

[54] SELF REGULATED APPARATUS FOR FEEDING CARDING MACHINES

[76] Inventors: Guido Bettoni, via Mazzini 1, Erbusco (Brescia); Cesare Bettoni, via Lazzaretto 54, Adro (Brescia), both of Italy

[21] Appl. No.: 262,894

[22] Filed: May 12, 1981

[51] Int. Cl.[3] ..... D01G 9/00

[52] U.S. Cl. ..... 19/80 R; 19/85; 19/105; 19/107; 19/200

[58] Field of Search ..... 19/80 R, 85, 97.5, 105, 19/107, 200

[56] References Cited

U.S. PATENT DOCUMENTS 3,548,461 12/1970 Reiterer ..... 19/97.5 X
3,709,406 1/1973 Binder et al. ..... 19/105 X
3,896,523 7/1975 Beukert ..... 19/105
4,240,180 12/1980 Wood et al. ..... 19/105
4,300,267 11/1981 Winch et al. ..... 19/85 X

*Primary Examiner*—Louis Rimrodt
*Attorney, Agent, or Firm*—McGlew and Tuttle

[57] ABSTRACT

The apparatus in accordance with the present invention comprises a fiber preparatory unit having means for opening the material and regulating the type of wad which is to form the mattress. Also included are means for the recovery and recycling of the excess material and one or more units for the formation and preparation of the wad mattresses with means for the regulated retrieval of the material from the preparatory unit. Means for the distribution of the material within the unit itself with the regulation of the type of mattress to be produced by each unit also comprise part of this invention.

11 Claims, 6 Drawing Figures

SELF REGULATED APPARATUS FOR FEEDING CARDING MACHINES

FIELD OF THE INVENTION

The present invention relates to apparatus for the preparation of small mattresses of cotton wads for feeding to carding machines.

BACKGROUND OF THE INVENTION

Devices of the type and for the purpose indicated hereabove are already known. These prior art devices comprise means for preparation of the fibers and means for dosing the material for the formation of small mattresses of cotton, rayon, synthetic fiber, etc. These known devices however are not free from serious inconveniences and drawbacks, especially with respect to the uniformity of distribution of the material in the formation of the wads and in the possibility of a careful and minute control of the wad and of the recycling of the excess material which is not accepted by the carding machine.

BRIEF SUMMARY OF THE INVENTION

It is an object of the present invention to provide an apparatus for feeding carding machines, which has means for self-regulation so as to permit, on the one hand, the uniform and correct distribution of the materials in order to obtain a mattress of wad of the type desired and, on the other hand, an automatic recycling of the surplus and excess material within the body of the device for the preparation of the fiber without involving the container which feeds the carding machines or the carding machines themselves.

For this purpose the apparatus in accordance with the present invention comprises a preparatory unit for the fiber with means for opening the material and the nominal regulation of the type of wad which is to form the mattress; means for the recovery and recycling of the excess material; one or more units for the formation and preparation of the wad mattresses with means for the regulated retrieval of the material from the preparatory unit; and means for the distribution of the material within the unit itself with the possibility of minute and detailed regulation of the type of mattress to be produced by each unit.

BRIEF DESCRIPTION OF THE DRAWINGS

Greater details of the invention will become evident from the following description of embodiments thereof, with reference to the accompanying drawings which are illustrative and not limitative of the invention and in which.

DETAILED DESCRIPTION OF THE INVENTION

Figure 1:
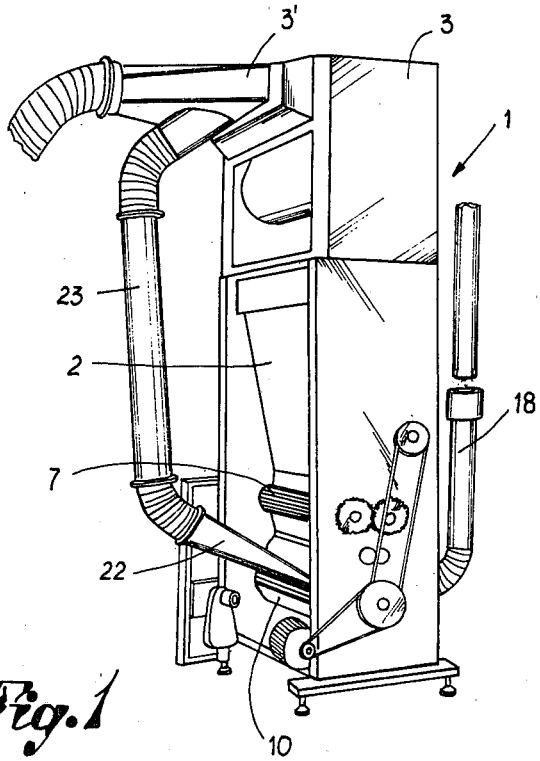
FIG. 1 is a perspective view of the preparatory unit of the fiber having means for the automatic recycling of the excess material.

With reference to the accompanying drawings, reference character 1 represents, in general, the unit positioned before the opening and for preparation of the fiber, the unit comprising a vertical hopper container 2 having mounted on the upper part thereof a condenser or aspiration cage 3, which is known per se and which serves to convey the material to be retained within the container 2. The container 2 has a beating portion 4 which may be displaced by means of suitable cams 5, as well as a photocell 6 for determining the level of the material within the container itself. On the bottom of the container 2 there are provided a pair of variable speed, grooved rollers 7 and a pair of variable speed rollers 8. The two pairs of rollers 7 and 8 rotate so as to take the material from the container 2 and transport it to a chamber 9 defined by a cylindrical body 10 within which operates a beating drum 11 that serves to open the material or, in any case to reduce it into small bits.

Figure 2:
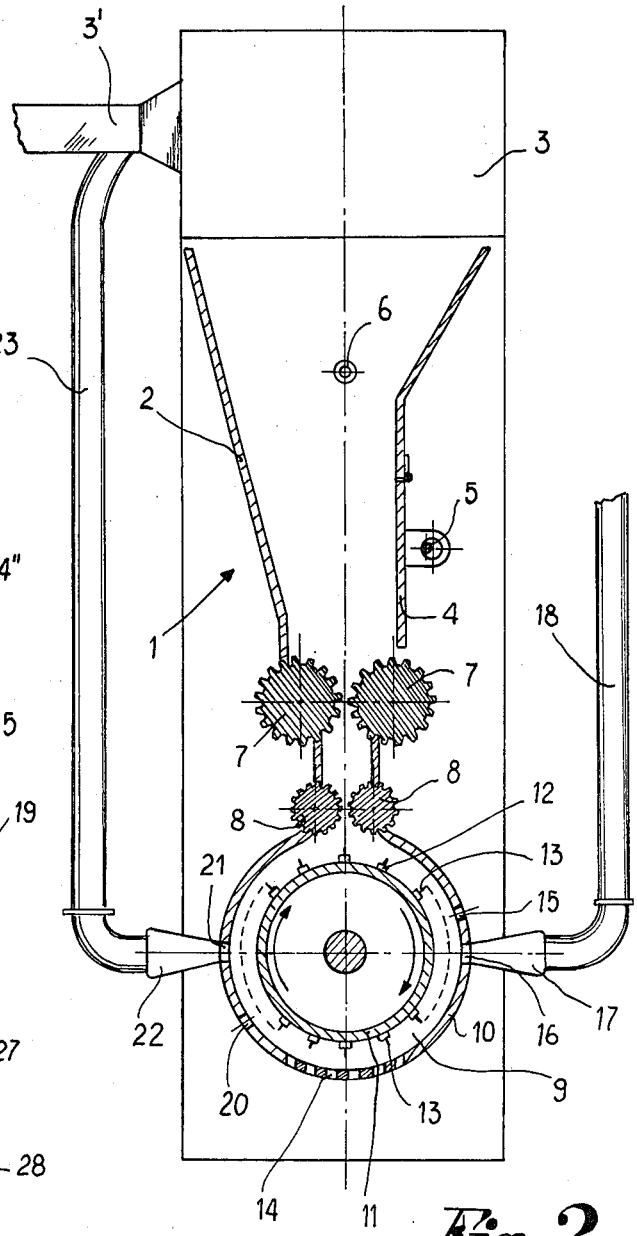
FIG. 2 is a vertical sectional view of the preparatory unit of FIG. 1.

In a preferred embodiment, represented by FIG. 2, the beating drum 11 comprises a cylindrical body on the surface of which there are provided longitudinal filetted elements 12, each carrying a plurality of radial points or tips 13. The variable speed of the pairs of rollers 7 and 8 for the retrieval of the material from the bottom of the container 2 and the action of the beating drum 11 with radial tips 13 permit the nominal regulation of the type of wad which is to be produced and which is to be fed to the carding machines.

The bottom of the chamber 9 in which the beating drum 11 operates, might be provided, if so desired and when necessary, with a grid 14 for the eventual discharging of heavy items which might be present in the material and which are attached thereto.

On one side of the cylindrical body 10 which defines the chamber 9 there are provided, adjacent to each other, a cut 15 for the aspiration of outer air and a longitudinal cut 16 to which are coupled the aspiration outlets 17 of one, two or more conduits 18. These conduits 18 serve to retrieve the material from the chamber 9 and convey it to one, two or more corresponding units 19 which are positioned before the formation of the wad mattresses for feeding a corresponding number of carding machines (not shown).

Also, on the opposite part of the cylindrical body 10 which defines the chamber 9, there are provided a cut 20 for the aspiration of outer air and a longitudinal cut 21 to which is applied the aspiration inlet 22 of a conduit 23 which extends upwardly and which is connected to the inlet 3' of the condenser or aspiration cage 3 on top of the container 2. The conduit 23 permits the aspiration and, therefore, the retrieval from the chamber 9, of the excessive material which is not retrieved by the inlets of the conduits 18 for conveyance to units 19 for the formation of the wads. In this manner, the material which is in excess may always be recovered and recycled automatically and directly within the very same preparatory unit 1 by the same condenser or aspiration cage 3 feeding the unit.

Figure 3:
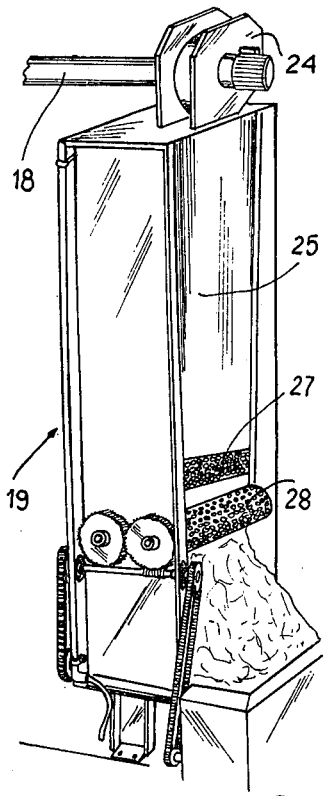
FIG. 3 is a perspective view of the container with means for the formation of the wad mattress.
Figure 5:
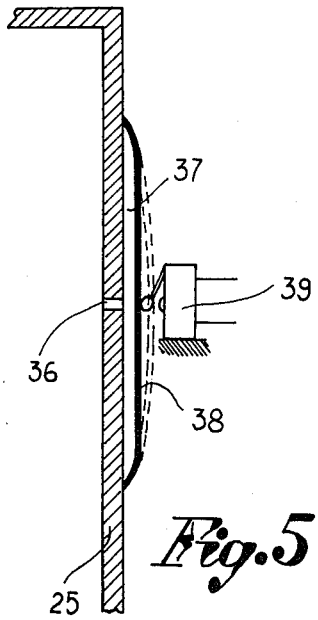
FIGS. 5 and 6 show two different details of the means for the regulation of the material, associated with the container of FIG. 3.
Figure 4:
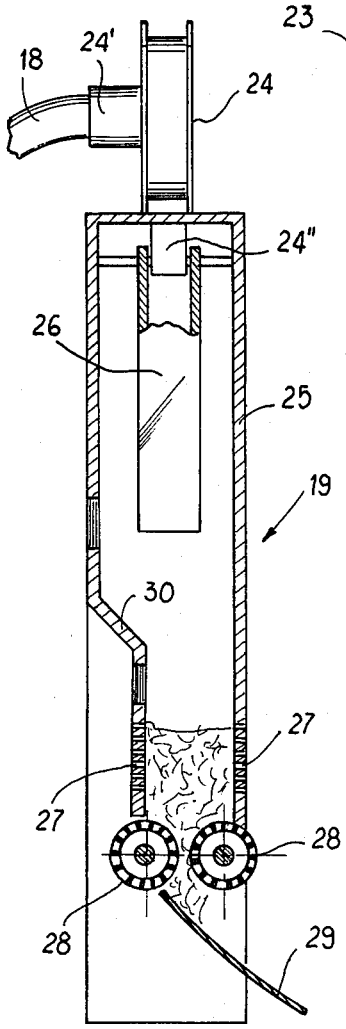
FIG. 4 is a vertical sectional view of the container of FIG. 3.

As is represented in FIGS. 3 and 4 of the accompanying drawings, each conduit 18 for the retrieval of the material from the chamber 9 extends until it is connected to a fan-aspirator 24 mounted on top of the unit 19 for the formation of the wad, the fan-aspirator 24 being of the type having an axial inlet 24' and a radial outlet 24", so as to avoid undesired curling of the fibers of the material.

Each unit 19 comprises, in turn, a vertical silo 25 into which extends a distribution tube 26 connected in its upper portion to the radial outlet 24" of the fan-aspirator 24 and displaceable pendularly by means of suitable control means for distributing uniformly the material along the entirety of said silo.

In its lower part, the silo 25 has outlet air openings 27 provided on two opposed walls, while on the floor of the silo 25 which is open, there are mounted two tubular rollers 28 which rotate in opposite direction and which retrieve the material from the silo 25 for the formation of the wad mattresses that, by following a sliding deflector 29, are transported to the carding machine to be fed.

Each of the rollers 28 has a plurality of radial openings which serve both as passages for the discharge of air and as means for dragging the material downwardly and therefore toward the outside of the silo 25.

It is to be noted furthermore that a part of the silo 25 may advantageously have an intermediate steplike portion 30 which serves to break the fall of the material that exits from the distributing tube 26, so that the material might come to rest softly upon that which is already present at the bottom of the silo 25.

Figure 6:
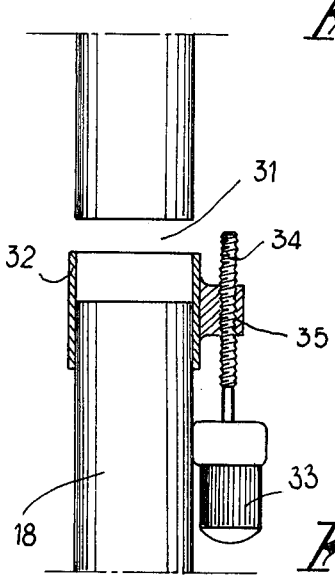

Furthermore, the conduit 18 for the retrieval of the material from the chamber 9 of the preparatory unit 1 may have, at any desired location along its length, an interruption or opening 31 (see FIG. 6) of an amplitude which may be regulated, for example, by means of a sleeve or a gate 32 that is displaceable and positionable along the tube itself.

The regulation of the interruption or opening 31 may be effected manually or automatically by mechanical means, electro-mechanical means, pneumatic means or other types of mechanism capable of varying, at will, the quantity of material carried to the silo 25 and, consequently, the type of wad mattress which exits from the silo 25.

For the automatic regulation of the opening 31 of each conduit 18 there may be provided, for example, an electric motor 33 that controls a screw 34 which engages an element 35 that is integrally coupled to the sleeve 32 to be displaced, without however excluding the use and employment of other actuating devices.

In the case illustrated, the electric motor 33 (or any other equivalent actuating means) could also be, in turn, automatically actuated depending on the level of the material in the silo 25 so as to maintain such level constant and to ensure the uniformity of the wad mattress produced.

For this purpose, on one side of the silo 25 there may be provided an opening 36 which directly communicates the inside of the silo 25 with an expandable chamber 37 that is defined by a flexible membrane 38 fixed onto a part of the silo 25, the membrane 38 acting upon a normally open microswitch 39 that is inserted in the electrical circuit of the motor 33 or connected electrically with other controlling means for the sleeve 32.

In practice, when there is insufficient flow of air from the silo 25 through the openings in the wall of the cylinders 10, independently of the level of material but dependently on the density of the material itself, the air introduced by the fan-aspirator 24 will have a tendency to accumulate in the silo to thereby increase the pressure therein existing. Such an increase in pressure is transmitted through the opening 36 to the flexible membrane 38, thus displacing it so as to close the microswitch 29 and activate the controlling means for the sleeve 32 which, in turn opens, in a different manner, the aperture 31 of the conduit 18. Thereafter, when the discharge of air through the opening 32 and the opening 28' is returned to normal, the conditions of operation will automatically be returned to their original condition, because the flexible membrane 38 will return to its condition of rest.

Such an arrangement permits the achievement of an optimum regulation of the type of wad mattresses to be transmitted or transported to the carding machine, the regulation being additionally carried out as a complement of the regulation effected by the preparatory unit of the fiber and by the manual changes effected on the regulation means connecting the preparatory unit to the unit forming the wad.

Therefore, the apparatus hereinabove described is self-regulating as far as the recycling of excess material is concerned and as far as the transportation of the material from the preparatory unit to the unit of formation of the wad, so that the feeding of the carding machine is as uniform as possible.

We claim:

1. A self-regulating system for the preparation of wads for feeding to carding machines, said apparatus comprising a preparatory unit for the fiber and at least one unit for the production of wad mattresses for feeding to an equal number of carding machines, said preparatory unit being connected to each of said wad production units through a first conduit with a fan-aspirator for the transportation of the material, characterized in that said preparatory unit comprises a hopper container on the upper part of which there is mounted a condenser for sending said material to said container; first and second pairs of rollers for retrieving the material from the bottom of said container and transporting it to a chamber defined by a cylindrical body; and a beater-drum rotatable within said chamber and having a plurality of tips for the opening and reduction of the material into smaller bits; and further characterized in that connected to said chamber are first aspiration inlets of said first conduit for the retrieval of said material from said chamber and second aspiration inlets of second conduit means connected only to said preparatory unit for the recycling of excess material which is not retrieved by said first conduit means; said second conduit means being connected to the inlet of said condenser for regulating an amount of material in said chamber.

2. The system according to claim 1, wherein each said wad production unit comprises a vertical silo on the top of which there is mounted a fan-aspirator for said first conduit for the retrieval of said material from said preparatory unit, a distribution tube (26) connected to the outlet of said fan-aspirator and pendularly displaceable within said silo, and a pair of rotating rollers mounted in correspondence to the bottom of said silo for the retrieval of said material from said silo and for the formation of a wad mattress, said silo having openings in the wall thereof for the outlet of air, while said rotating rollers are provided with a plurality of openings which serve as passages for the exit of air and as means for dragging said material.

3. The system according to claim 2, wherein said fan-aspirator has an axial inlet and a radial outlet.

4. The system according to claim 2, wherein a wall of said silo has at least an intermediate step-like portion for breaking the fall of the material exiting from said pendular distribution tube.

5. The system according to claim 1 wherein means are included for rotating said first and second pairs of rollers at variable speeds.

6. The system according to claim 1 wherein said beater drum comprises a cylindrical body on the circumference of which there are fixed longitudinal elements which include radially extending tips.

7. The system according to claim 1, wherein on said body which defines the chamber in which said beater drum operates there are provided cuts for the intake of air, adjacent to the inlets of said first conduit for the retrieval of said material and adjacent to the inlet of said second conduit means for the excess material.

8. The system according to claim 1, wherein each said first conduit has at least one opening, the width of which is variable by means of a sleeve guided along said first conduit.

9. The system according to claim 8, wherein said sleeve is displaceable and positionable manually with respect to the opening of said first conduit.

10. The system according to claim 8, wherein said sleeve is displaceable and positionable with respect to the opening of said first conduit by mechanical means having at least one electrically-fed actuating means.

11. The system according to claim 10 wherein on one wall of said silo there is provided an opening in correspondence to which, externally of said wall, there is attached a flexible membrane which defines a chamber that is expandable as a result of increases in air pressure within said silo, said membrane cooperating with a microswitch in the electrical circuit of said actuating means of said mechanical means for the displacement of said sleeve.

* * * * *